US007322049B1

(12) United States Patent
Kennedy, Jr.

(10) Patent No.: US 7,322,049 B1
(45) Date of Patent: Jan. 29, 2008

(54) NECKTIE

(76) Inventor: Alberto Victor Kennedy, Jr., 8615 NW. 8th St., Miami, FL (US) 33126

( * ) Notice: Subject to any disclaimer, the term of this patent is extended or adjusted under 35 U.S.C. 154(b) by 0 days.

(21) Appl. No.: 11/398,899

(22) Filed: Apr. 7, 2006

(51) Int. Cl.
*A41D 25/00* (2006.01)

(52) U.S. Cl. ..... 2/144

(58) Field of Classification Search ..... 2/144–151, 2/152.1, 153–157; 24/600, 604, 608, 609
See application file for complete search history.

(56) References Cited

U.S. PATENT DOCUMENTS 2,100,870 A * 11/1937 Petrie et al. ..... 2/145
2,918,678 A * 12/1959 Gouner ..... 2/144
3,946,444 A * 3/1976 Parrilla ..... 2/144
5,016,285 A * 5/1991 Just ..... 2/144
5,461,726 A * 10/1995 Wade ..... 2/144
5,815,835 A * 10/1998 Craddock ..... 2/144

* cited by examiner

*Primary Examiner*—Tejash Patel
(74) *Attorney, Agent, or Firm*—Albert Bordas, P.A.

(57) ABSTRACT

A necktie comprising, a tie having a through opening, an accessory piece, and means to secure the accessory piece onto the tie. A user in a first configuration wears the tie when the accessory piece is secured onto the tie, and the tie is tied in a knot. The tie is worn by a user in a second configuration when the accessory piece is secured onto the tie and the lower end of the at least one accessory piece is inserted through the through opening. The means to secure the accessory piece onto the tie comprises removable securing means or permanent securing means. The accessory piece may be a same or different color as the tie and the accessory piece may also be a same or different pattern as the tie.

9 Claims, 5 Drawing Sheets

NECKTIE

BACKGROUND OF THE INVENTION

1. Field of the Invention

The present invention relates to ties, and more particularly, to neckties comprising accessories mounted thereon.

2. Description of the Related Art

Several designs for neckties have been developed in the past. None of them, however, include a through opening conveniently disposed on the front apron, and an accessory piece that can be removably mounted to the necktie.

SUMMARY OF THE INVENTION

A necktie comprising, a tie having a first end, a second end, an outwardly facing rear apron, an outwardly facing front apron, an inwardly facing rear apron, an inwardly facing front apron, and a through opening. The through opening is positioned on the outwardly facing front apron at a predetermined distance from the first end, without reaching the second end. An accessory piece includes an upper end, a lower end, an outwardly facing surface, an inwardly facing surface, and means to secure the accessory piece onto the tie.

A user in a first configuration wears the tie when the accessory piece is secured onto the tie, and the tie is tied in a knot. The tie is worn by a user in a second configuration when the accessory piece is secured onto the tie and the lower end of the at least one accessory piece is inserted through the through opening, from the outwardly facing front apron towards the inwardly facing front apron. A user in a third configuration wears the tie when the first end of the tie is inserted through the through opening.

The means to secure the accessory piece onto the tie comprises removable securing means or permanent securing means. The knot is a four-in-hand knot, Pratt knot, half-Windsor knot, or Windsor knot. The removable securing means includes ball and socket, or hook and loop, or hook and eye, or hook and clip type fasteners. The permanent securing means includes stitching. The accessory piece may be a same or different color as the tie. The accessory piece may be a same or different pattern as the tie.

It is therefore one of the main objects of the present invention to provide a necktie that includes a through opening on the front apron, to permit a user to tie the necktie in different configurations.

It is another object of this invention to provide a necktie that includes at least one removably mounted accessory piece to permit a user to show the same necktie with various combinations of colors and/or patterns.

It is another object of the present invention to provide a necktie that permits a user to showcase a more formal/elegant look.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 2, 3, 4:
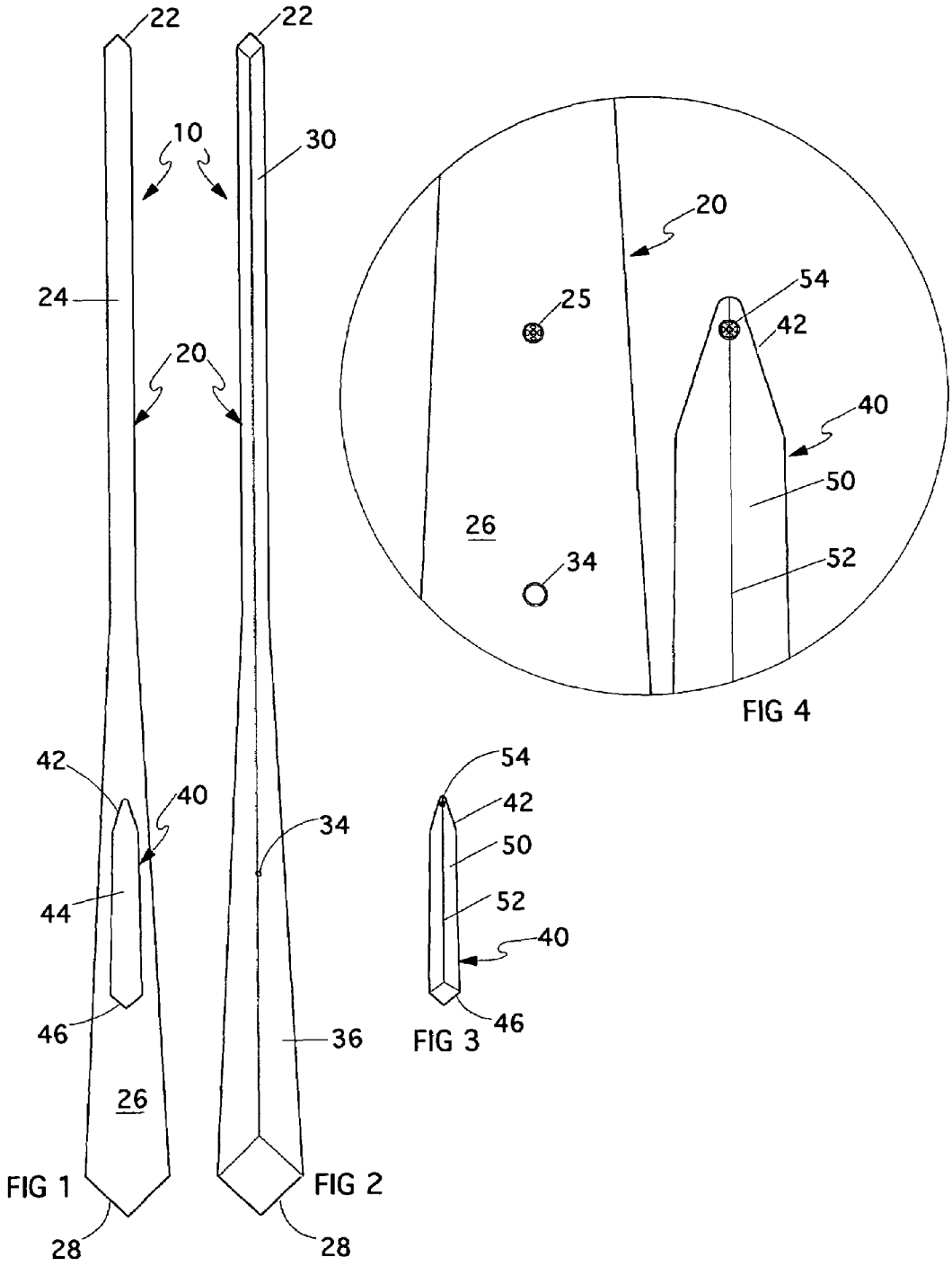
FIG. 1 represents a front elevational view of the preferred embodiment for a necktie, object of the present application, with its accessory piece mounted thereon.
FIG. 2 shows a rear elevational view of the necktie represented in FIG. 1, showing the position of the through opening.
FIG. 3 illustrates a rear elevational view of the accessory piece for the necktie.
FIG. 4 is a representation of an enlarged view of the present invention for necktie with the accessory piece (both are partially shown), showing the through opening, the ball-side snap and the socket-side snap.

Referring now to the drawings, where the necktie of the present invention is generally referred to with numeral 10, it can be observed that it basically includes tie 20 and accessory piece 40, as shown in FIG. 1.

As seen in FIGS. 1 and 2, tie 20 includes ends 22 and 28, outwardly facing rear apron 24, outwardly facing front apron 26, inwardly facing rear apron 30, and inwardly facing front apron 36. In addition, tie 20 includes through opening 34 at a predetermined position of outwardly facing front apron 26 and inwardly facing front apron 36, as best seen in FIG. 2.

As seen in FIGS. 1 and 3, accessory piece 40 basically includes upper end 42, lower end 46, outwardly facing surface 44, inwardly facing surface 50, and slip-stitched seam 52. Additionally, accessory piece 40 includes socket-side snap 54 fixedly mounted to inwardly facing surface 50 next to upper end 42 and positioned over slip-stitched seam 52.

As best seen in FIG. 4, outwardly facing front apron 26 has ball-side snap 25 that is aligned to snap into with socket-side snap 54 of accessory piece 40. Ball-side snap 25 is fixed at a predetermined distance from end 28. In the preferred embodiment, the distance between through opening 34 and ball-side snap 25 is substantially a half of the longitudinal size of accessory piece 40.

The instant invention may be used to tie a variety of typical necktie knots, including, but not limited, to the four-in-hand knot, Pratt knot, half-Windsor knot, and the Windsor knot.

Figure 5:
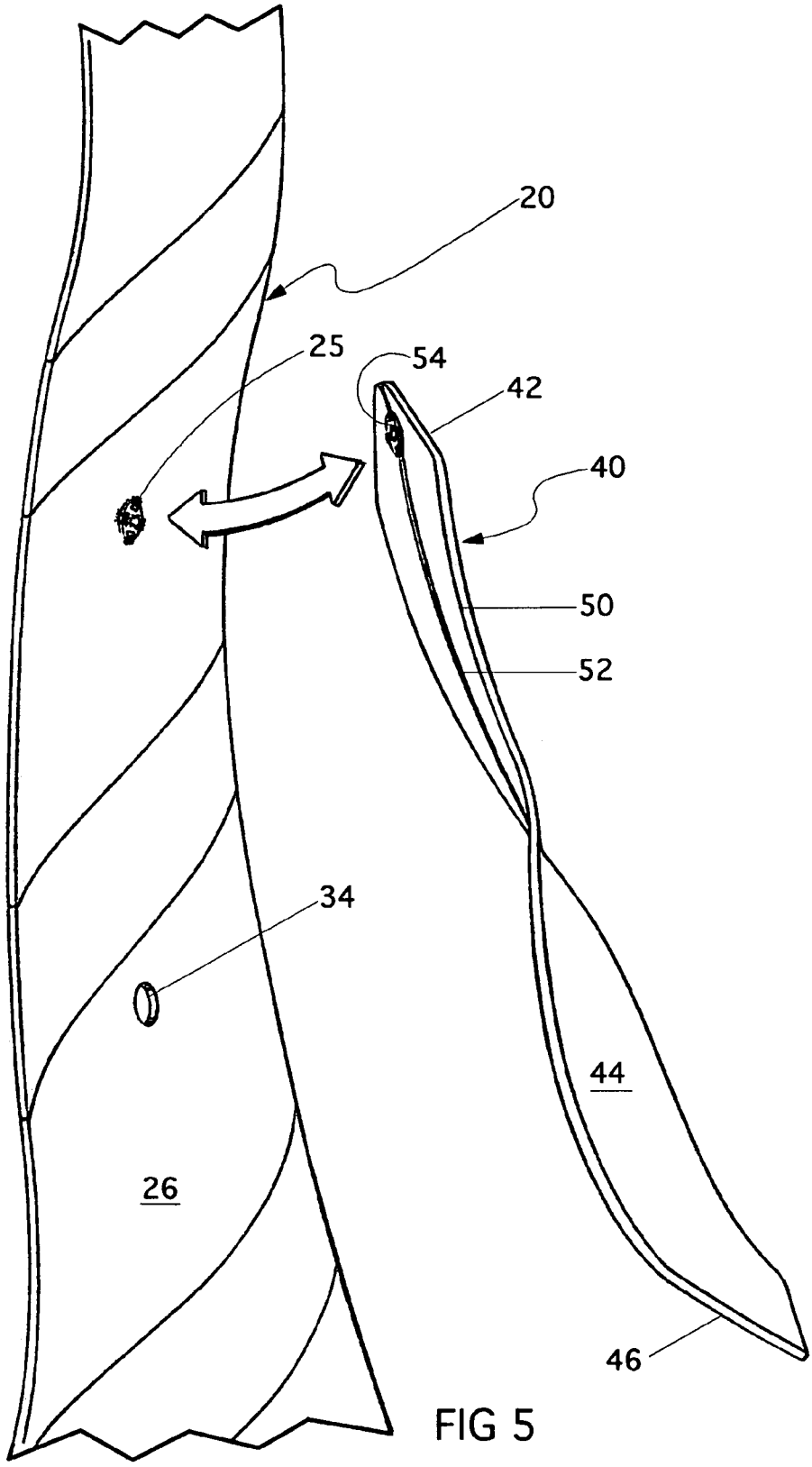
FIG. 5 is an isometric view of the necktie (partially shown), showing the accessory piece being mounted thereto.
Figure 6:
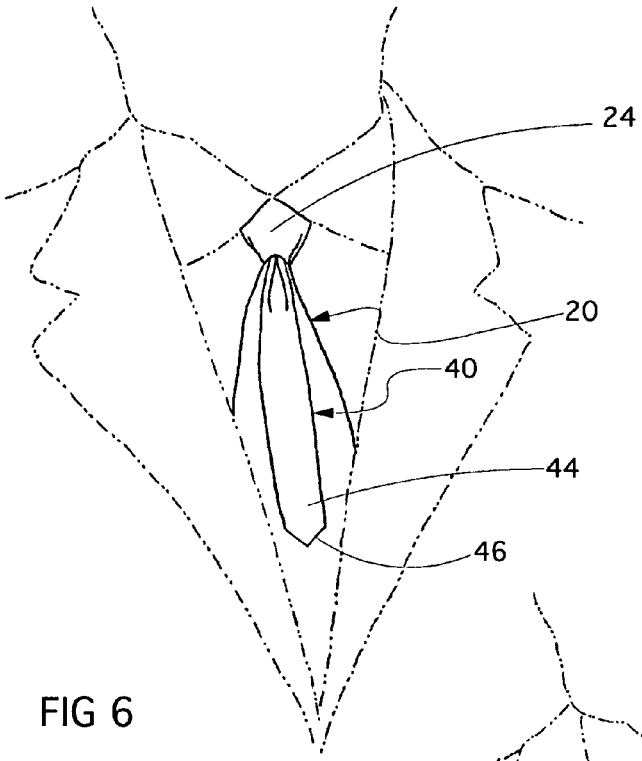
FIG. 6 is a representation of the necktie and accessory piece, showing one of the preferred configurations as worn by a user.
Figure 7:
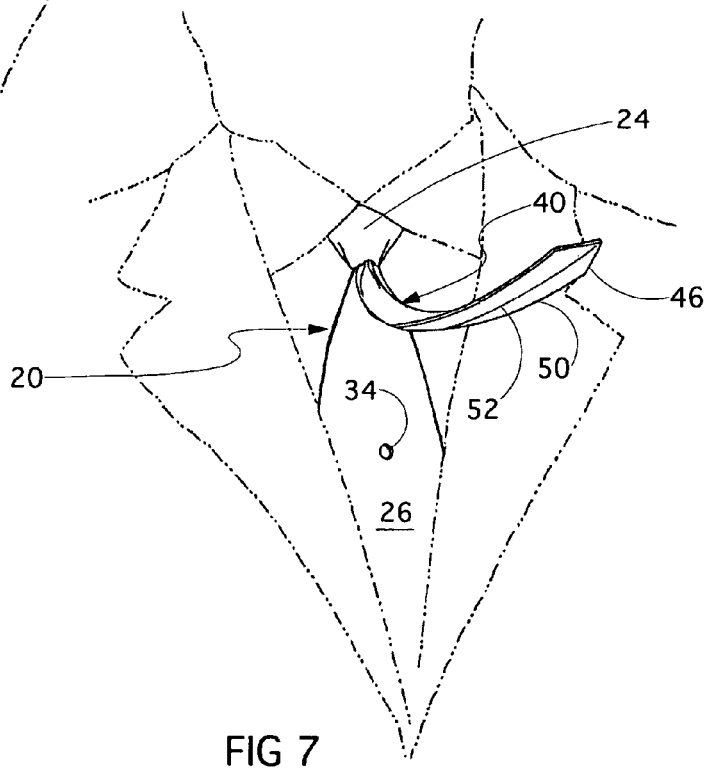
FIG. 7 is a representation of the necktie with the accessory piece lifted, and showing the necktie's through opening.
Figure 8:
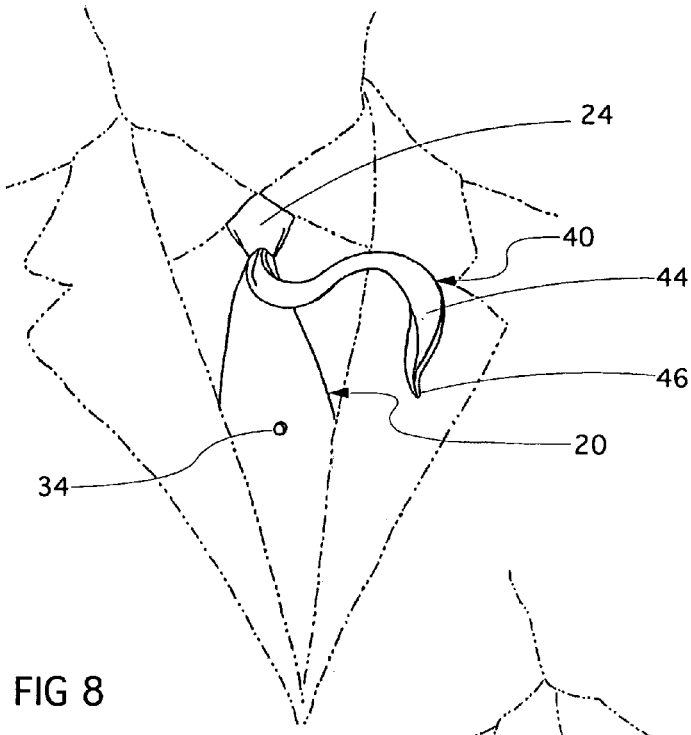
FIG. 8 is a representation of the necktie, and accessory piece positioned to be inserted through the through opening.
Figure 9:
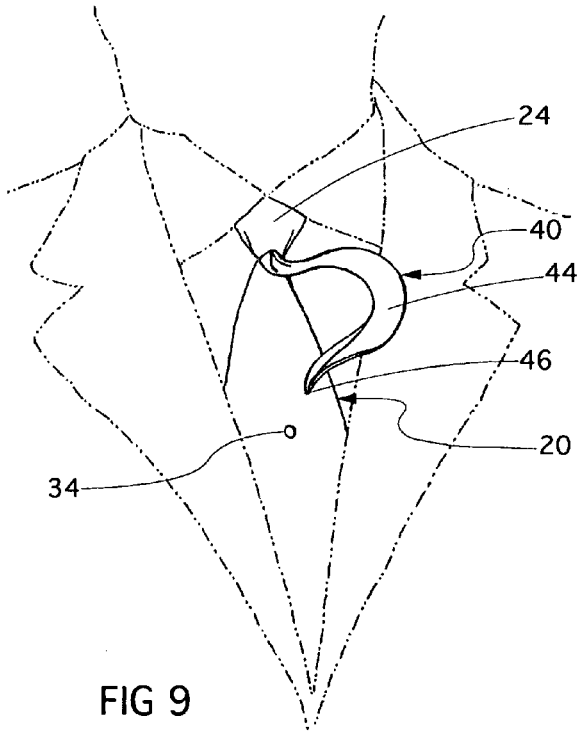
FIG. 9 is a representation of the necktie, and accessory piece positioned to be inserted through the through opening after the illustration in FIG. 8.
Figure 10:
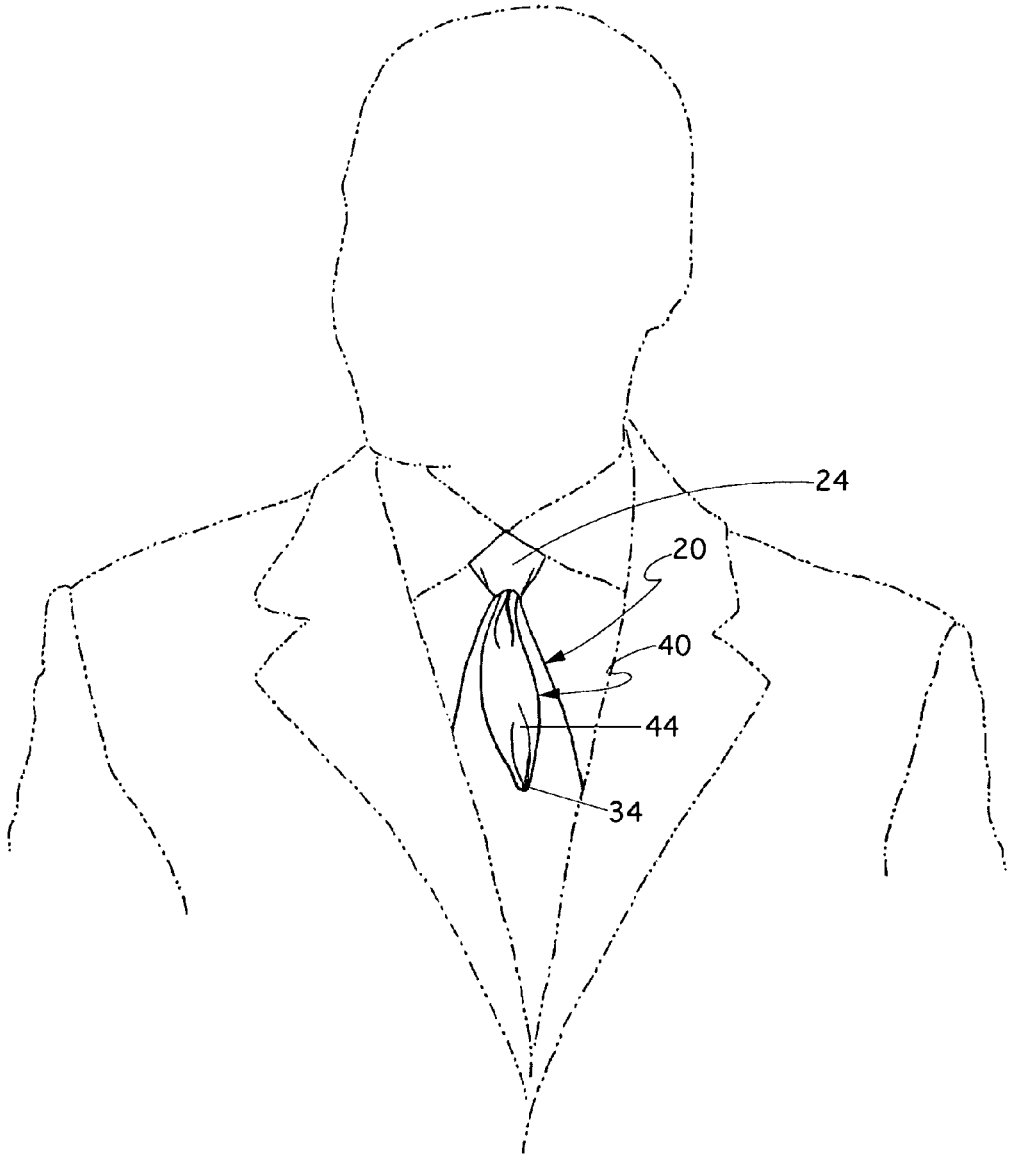
FIG. 10 is a representation of the necktie and accessory piece worn in an alternate configuration.

As shown in FIG. 5, a user mounts accessory piece 40 onto tie 20 by pressing socket-side snap 54 against ball-side snap 25. As seen in FIG. 6, the user may tie a knot with tie 20 having accessory piece 40 mounted thereon. The user can use the present invention 10 as shown in FIG. 6 or he may insert lower end 46 through opening 34, as shown in FIGS. 7; 8; and 9, to the configuration shown in FIG. 10. The user may combine accessory pieces 40 of different colors and/or patterns with the same tie 20 or vice-versa.

Alternatively, socket-side snap 54 and ball-side snap 25 could be replaced by other removable mounting means such as hook and loop fasteners including "VELCRO", button and eyelet fasteners, and hook and eye or clip members, among others.

In an alternate embodiment, accessory piece 40 is permanently fixed onto tie 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A necktie (10) comprising, a tie (20) having a first end (22), a second end (28), an outwardly facing rear apron (24), an outwardly facing front apron (26), an inwardly facing rear apron (30), an inwardly facing front apron (36), and a single through opening (34), said single through opening (34) positioned on said outwardly facing front apron (26) at a predetermined distance from said first end (22) without reaching said second end (28), said necktie (10) further comprising a removable accessory piece (40), said removable accessory piece (40) including an upper end (42), a lower end (46), an outwardly facing surface (44), an inwardly facing surface (50), and means to secure said removable accessory piece (40) onto said outwardly facing front apron (26), said tie (20) is tied in a knot while worn by a user in a first configuration when said removable accessory piece (40) is secured onto said outwardly facing front apron (26) and extends from said knot defining a crease, said tie (20) is worn by a user in a second configuration when said removable accessory piece (40) is secured onto said tie (20) and said lower end (46) of said removable accessory piece (40) is inserted through said single through opening (34) from said outwardly facing front apron (26) towards said inwardly facing front apron (36).

2. The necktie (10) set forth in claim 1, further characterized in that said tie (20) is worn by a user in a third configuration when said first end (22) of said tie (20) is inserted through said single through opening (34).

3. The necktie (10) set forth in claim 2, further characterized in that said means to secure said removable accessory piece (40) onto said outwardly facing front apron (26) comprises removable securing means.

4. The necktie (10) set forth in claim 3, further characterized in that said knot is a four-in-hand knot, Pratt knot, half-Windsor knot, or Windsor knot.

5. The necktie (10) set forth in claim 3, further characterized in that said removable securing means includes ball and socket, or hook and loop, or hook and eye, or hook and clip type fasteners.

6. The necktie (10) set forth in claim 4, further characterized in that said removable accessory piece (40) is a same color as said tie (20).

7. The necktie (10) set forth in claim 4, further characterized in that said removable accessory piece (40) is a different color as said tie (20).

8. The necktie (10) set forth in claim 4, further characterized in that said removable accessory piece (40) is a same pattern as said tie (20).

9. The necktie (10) set forth in claim 4, further characterized in that said removable accessory piece (40) is a different pattern as said tie (20).

* * * * *